US008307797B2

(12) United States Patent
Meintschel et al.

(10) Patent No.: US 8,307,797 B2
(45) Date of Patent: Nov. 13, 2012

(54) INTERNAL COMBUSTION ENGINE VALVE DRIVE TRAIN SHIFTING DEVICE

(75) Inventors: Jens Meintschel, Bernsdorf (DE); Thomas Stolk, Kirchheim (DE); Alexander Von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 361 days.

(21) Appl. No.: 12/799,788

(22) Filed: Apr. 30, 2010

(65) Prior Publication Data

US 2010/0236506 A1 Sep. 23, 2010

Related U.S. Application Data

(63) Continuation-in-part of application No. PCT/EP2008/008695, filed on Oct. 15, 2008.

(30) Foreign Application Priority Data

Nov. 2, 2007 (DE) ..... 10 2007 052 249

(51) Int. Cl.
*F01L 1/34* (2006.01)

(52) U.S. Cl. ..... 123/90.18; 123/90.44; 123/90.6

(58) Field of Classification Search ..... 123/90.18, 123/90.44, 90.6; 74/567, 569
See application file for complete search history.

(56) References Cited

U.S. PATENT DOCUMENTS 5,289,806 A * 3/1994 Hurr ..... 123/90.17

FOREIGN PATENT DOCUMENTS

| | | |
|---|---|---|
| DE | 198 33 621 | 1/2000 |
| DE | 10 2004 021 375 | 1/2006 |
| DE | 10 2004 055 852 | 4/2006 |
| DE | 10 2007 010 157 | 6/2008 |
| JP | 60 204922 | 10/1985 |

* cited by examiner

*Primary Examiner* — Ching Chang
(74) *Attorney, Agent, or Firm* — Klaus J. Bach

(57) ABSTRACT

In an internal combustion engine valve drive train shifting device including a camshaft having at least two shifting units arranged on the camshaft in spaced relationship, at least one coupling unit is provided interconnecting the at least two shifting units for shifting purposes.

8 Claims, 3 Drawing Sheets

INTERNAL COMBUSTION ENGINE VALVE DRIVE TRAIN SHIFTING DEVICE

This is a Continuation-in-Part Application of pending international patent application PCT/EP2008/008695 filed Oct. 15, 2008 and claiming the priority of German patent application 10 2007 052 249.7 filed Nov. 2, 2007.

BACKGROUND OF THE INVENTION

The invention relates to an internal combustion engine valve train shifting device with at least two shifting units and coupling units.

DE 10 2004 021 375 AI discloses an internal combustion engine valve train switching device with two shifting units which are both supported so as to be axially movable.

It is the principal object of the invention to provide for a high flexibility in shifting cam shifting units for actuating the inlet and outlet valves of an internal combustion engine.

SUMMARY OF THE INVENTION

In an internal combustion engine valve train shifting device including a camshaft having at least two shifting units arranged on the camshaft in spaced relationship at least one coupling unit is provided at least two of the shifting units are interconnecting for shifting purposes.

Preferably, the coupling unit is provided to indirectly connect at least two of the shifting units for shifting purposes. "Provided" is in particular meant to be especially equipped and/or designed. A "shifting unit" is a unit which is provided to cooperate in a shifting process, in particular in a direct cooperation with at least one shifting means or another unit. A "shifting process" refers to a relative movement and especially an axial relative movement between two components. A "shifting means" is a means which is provided to effect a shifting process, in particular also in cooperation with at least one shifting unit or another unit, and which is in the present case a shifting pin. A "coupling unit" is a unit which interconnects two units. Two units being connected "for shifting purposes" means that at least one shifting process is present, where a shifting process is effected by one of the units in which the other one of the shifting units takes part. Two units being connected "indirectly" for shifting purposes is in particular meant to be that the two units are connected and that a unit, which is especially formed as a shifting unit is arranged between the units, whose movement state is at least partially independent and disconnected from shifting processes of the two units. A third unit being arranged "between" a first and a second unit, means that at least one point of the first unit and a point of the second unit is present, so that a path connecting the two points and proceeding in particular in an axial direction intersects the third unit. A high flexibility with shifting processes of shifting units can be achieved with an arrangement of the invention.

The at least two shifting units are advantageously arranged on the same shaft. Preferably, the shifting unit encloses the shaft and/or is connected thereto for rotation with the shaft or it can be moved in an axial direction along the shaft. A simple construction can be achieved hereby.

It is further suggested that the internal combustion engine valve train shifting device has at least one unit, within which the coupling unit extends at least to a considerable part. The coupling unit extending "to a considerable part" within a unit means that at least twenty five percent, especially at least fifty percent, especially at least seventy percent, and especially advantageously more than eighty five of the length of the coupling unit extends within the unit. A compact construction can be achieved hereby.

The unit is preferably a shifting unit. A high shifting variability of successive shifting units can be achieved hereby. It is additionally suggested that the unit is in the form of a hollow shaft. A particularly simple construction can be achieved in this manner.

The coupling unit is preferably fastened to at least one of the shifting units by means of a form-fit connection. Components can thereby be saved in an advantageous manner, and a safe force transfer can be achieved, especially if the form-fit connection is present in at least one shifting direction, that is in particular an axial direction.

The coupling unit advantageously interconnects the two shifting units in at least one axial direction. An "axial direction" is in particular meant to be a direction parallel to a rotational axis of a shaft. Hereby, shifting processes of shifting units remote from each other can be carried out combined in the axial direction.

It is further suggested that the coupling unit provides a pulling connection and/or a pushing connection. Thereby, a position of a unit driven by a shaft can be adjusted in a simple and precise manner.

The invention will become more readily apparent from the following description of a particular embodiment thereof on the basis of the accompanying drawings.

DESCRIPTION OF A PARTICULAR EMBODIMENT

Figure 1:
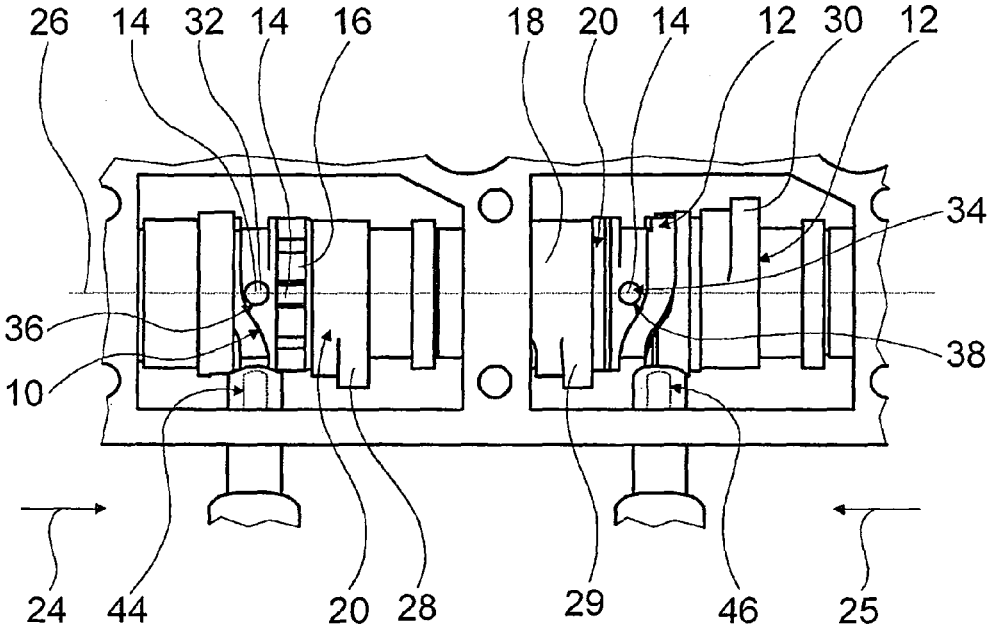
FIG. 1 is a top view of an internal combustion engine valve train switching device.

FIG. 1 is a top view of an internal combustion engine valve drive train switching device disposed on a camshaft 16, which is supported so as to be rotatable about an axis 26. The internal combustion engine valve train switching device has two shifting units 10, 12 formed in one piece, which are indirectly connected by a coupling unit 14 for shifting purposes. In a direction parallel to the rotational axis 26, a unit 18 is arranged between the shifting units 10, 12, which is formed as a one-piece shifting unit 20. The shifting units 10, 12, 20 are arranged next to each other on the shaft 16 and enclose the shaft in a sleeve-like manner. The shaft 16 transmits a torque to the shifting units 10, 12, 20 in the operating mode. The shifting unit 10 has a control gate which is provided to effect an axial displacement of the shifting unit 10 relative to the shaft 16 in an axial direction 24 extending parallel to the rotational axis 26, and towards the shifting unit 12 in cooperation with a shifting pin 44. The shifting unit 20 is a cam carrier and has cams 28, 29, which are provided for actuating valves. The shifting unit 12 comprises a control gate and a cam 30. The control gate is provided to effect a displacement of the shifting unit 12 in a direction 25 opposite to the direction 24 in cooperation with a shifting pin 46. It is also conceivable in principle that at least one of the shifting units 10, 12 is formed as a pure cam carrier.

Figure 2:
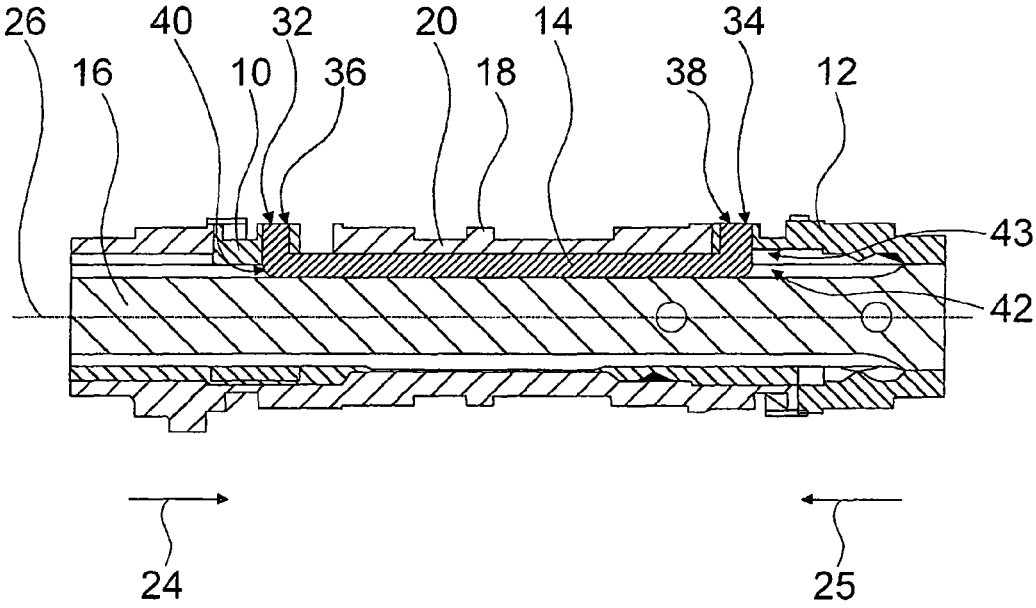
FIG. 2 is a sectional view of the internal combustion engine valve train switching device.

FIG. 2 shows a section through the internal combustion engine valve train switching device. The sectional plane includes the axis of rotation 26 of the shaft 16. A main extension direction of the coupling unit 14 formed in one piece is parallel to the direction 24. The coupling unit 14 connects the two shifting units 10, 12 in the axial direction 24, 25. For this, angled members 32, 34 are respectively formed at two ends of a basic body of the coupling unit 14, which is formed by a rod. The angled members 32, 34 are inserted in recesses 36, 38 of the shifting units 10, 12. In this manner, the coupling unit is secured with regard to movements relative to the shifting units 10, 12 along the rotational axis 26 and in a circumferential direction of the shaft 16 at the shifting units 10, 12. Due to this form-fit, the axial displacements of the shifting unit 10 are transferred to the shifting unit 12 in the direction 24, which exert a pressure on the coupling unit 14 and thus on the shifting unit 12. Analogously, axial displacements of the shifting unit 12 are transferred in the direction 25 on the shifting unit 10. The shifting units 10, 12 carry out the same movements along the rotational axis 26.

The coupling unit 14 further extends to a considerable part within the shifting unit 20, which is decoupled from the axial displacements of the shifting units 10, 12. The coupling unit 14 abuts the shifting unit 20 and the shaft 16 and is thus fixed in a radial direction with regard to the rotational axis 26 in a form-fitting manner. The shaft 16 has recesses 40, 42, 43, which are provided to receive a part of the basic body of the coupling unit 14 so as to permit a corresponding axial displacement.

Figure 3:
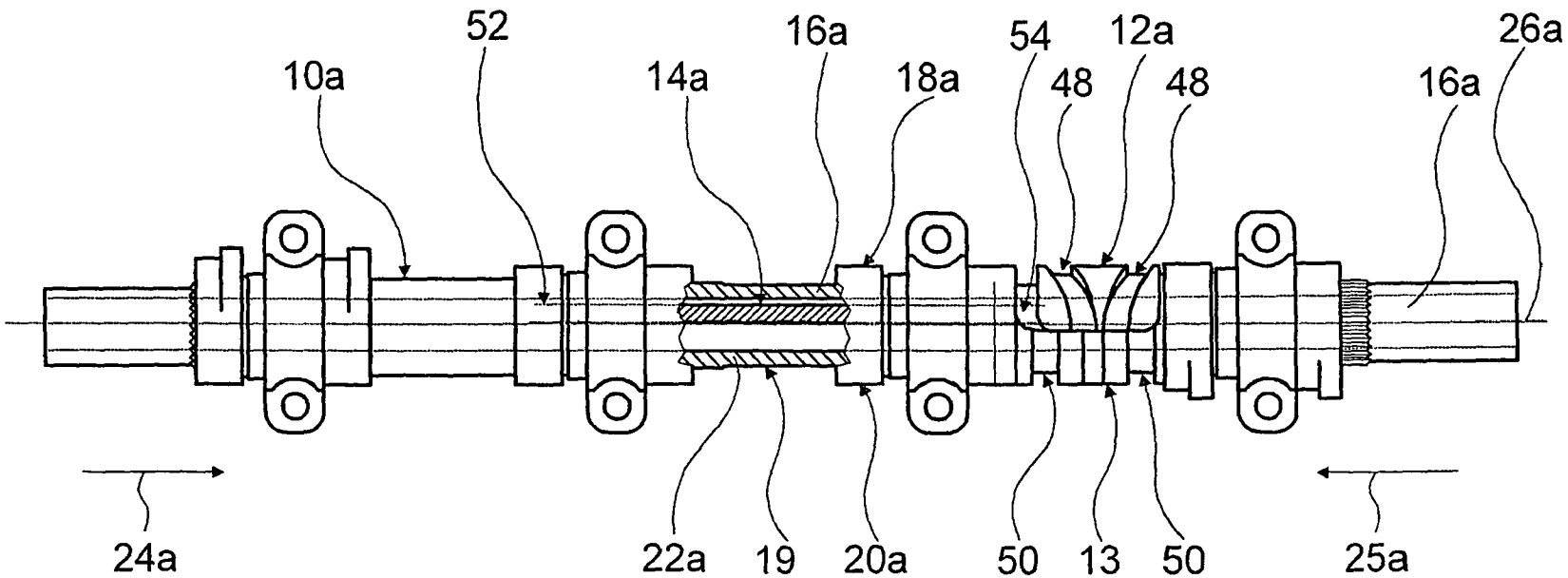
FIG. 3 is a top view of an alternative embodiment of an internal combustion engine valve train switching device.

FIG. 3 shows an alternative embodiment of an internal combustion engine valve train switching device. Components, characteristics and functions essentially remaining the same are in principle designated by the same reference numerals. For distinguishing the embodiments, the letter "a" has been added to the reference numerals of the embodiment shown in FIG. 3. The following description is essentially restricted to the differences to the embodiment of FIGS. 1 and 2, wherein one can refer to the description of FIGS. 1 and 2 with regard to the same components, characteristics and figures.

The internal combustion engine valve drive train switching device depicted in FIG. 3 has two shifting units 10*a*, 12*a*, which are arranged on a shaft 16*a*. In a main extension direction of the shaft 16*a*, a further unit 18*a* is arranged between the shifting units 10*a*, 12*a*, which is a shifting unit 20*a*. The shaft 16*a* rotates in an operating mode around a rotational axis 26*a* and respectively transfers a torque to the shifting units 10*a*, 12*a*, 20*a*. The shifting units 10*a*, 20*a* are formed as cam carriers and enclose the shaft 16*a* in a sleeve-like manner. A further shifting unit 13 is arranged on the shaft 16*a*, which unit surrounds the shaft 16*a* over 180 degrees of a rotational angle of the shaft 16*a* like the shifting unit 12*a*. The shifting unit 13 further engages in the shifting unit 12*a* and is arranged movable relative thereto along the rotational axis 26*a*. The shifting units 12*a*, 13 enclose the shaft 16*a* together in a sleeve-like manner. The shifting units 12*a*, 13 have groove-like control cams 48, 50, which are provided to accommodate shifting pins, not shown. The shifting units are hereby arranged in such a manner that, in the operating mode, a shifting pin when leaving one of the radial cams 48, 50 enters another one of the radial control cams 48, 50. The shifting unit 12*a* can be selectively displaced relative to the rotational axis 26*a* in an axial direction 24*a* parallel to the rotational axis 26*a* away from the shifting unit 20*a* or in a direction 25*a* directed opposite to the direction 24*a*.

A coupling unit 14*a* connects the shifting units 10*a*, 12*a* in an indirect way for shifting purposes. The coupling unit 14*a* extends mainly parallel to the axis 26*a*. The coupling unit 14*a* is a one piece structure and is fastened at a first end region 52 to the shifting unit 10*a*. At a second end region 54, the coupling unit 14*a* is fastened to the shifting unit 12*a* of the coupling unit 14*a*. The end regions 52, 54 are disposed opposite one another in the main extension direction of the coupling unit 14*a*. The coupling unit extends to a considerable part within the shifting unit 20*a*. The coupling unit 14*a* further extends to a considerable part within the shaft 16*a* which is a hollow shaft 22. During a displacement of the shifting unit 12*a* in the direction 24*a*, a pulling force is exerted on the coupling unit 14*a*, and on the shifting unit 10*a*. The shifting unit 10*a* is hereby displaced together with the shifting unit 12*a* in the direction 24*a* relative to the shaft 16*a*. Furthermore, during a displacement of the shifting unit 12*a* in the direction 25*a*, a pressure force is exerted on the coupling unit 14*a* and thus on the shifting unit 10*a*, so that the two shifting units 10*a*, 12*a* are displaced relative to the shaft 16*a* in the direction 25*a*. The coupling unit 14*a* interconnects the two shifting units 10*a*, 12*a* in the axial directions 24*a*, 25*a*.

What is claimed is:

1. An internal combustion engine valve drive train shifting device including a shaft (16) carrying at least two spaced shifting units (10, 12; 10*a*, 12*a*) axially movably supported on the shaft (16) and at least one coupling unit (14; 14*a*), extending between the at least two spaced shifting units at least partially within the shaft (16) to interconnect the at least two spaced shifting units (10, 12; 10*a*, 12*a*) for shifting the at least two spaced shifting units (10, 12; 10*a*, 12*a*).

2. The internal combustion engine valve drive train shifting device according to claim 1, wherein the at least one coupling unit is slidably arranged en within a guide groove (42) formed in the shaft (16; 16*a*).

3. The internal combustion engine valve drive train shifting device according to claim 1, wherein the shaft (16) extends, at least over a considerable length thereof, through at least one unit (18; 18*a*, 19), within which also the coupling unit (14; 14*a*) is accommodated.

4. The internal combustion engine valve drive train shifting device according to claim 3, wherein the at least one unit (18; 18*a*) is formed as a shifting unit (20; 20*a*).

5. The internal combustion engine valve drive train shifting device according to claim 3, wherein the at least one unit (19) is a hollow shaft (22).

6. The internal combustion engine, valve drive train shifting device according to claim 1, wherein the at least one coupling unit (14) is fastened to at least one of the at least two spaced shifting units (10, 12) by means of a form-fit connection.

7. The internal combustion engine valve drive train shifting device according to claim 1, wherein the at least one coupling unit (14; 14*a*) interconnects the at least two spaced shifting units (10, 12; 10*a*, 12*a*) for common movement in at least one axial direction (24, 25; 24*a*, 25*a*).

8. The internal combustion engine valve drive train shifting device according to claim 1, wherein, when operated, the coupling unit (14; 14*a*) transmits a pulling force or, respectively, a pushing force between the at least two spaced shifting units (10, 12).

* * * * *